US009612052B2

(12) United States Patent
Park et al.

(10) Patent No.: US 9,612,052 B2
(45) Date of Patent: Apr. 4, 2017

(54) DRYING DEVICE

(71) Applicant: Samsung SDI Co., Ltd., Yongin-si, Gyeonggi-do (KR)

(72) Inventors: Jihyang Park, Yongin-si (KR); Kwanseop Song, Yongin-si (KR); Kyoungheon Heo, Yongin-si (KR); Seonhyeok An, Yongin-si (KR)

(73) Assignee: Samsung SDI Co., Ltd., Giheung-gu, Yongin-si, Gyeonggi-do (KR)

( * ) Notice: Subject to any disclaimer, the term of this patent is extended or adjusted under 35 U.S.C. 154(b) by 435 days.

(21) Appl. No.: 13/752,551

(22) Filed: Jan. 29, 2013

(65) Prior Publication Data

US 2013/0305556 A1 Nov. 21, 2013

(30) Foreign Application Priority Data

May 16, 2012 (KR) ..... 10-2012-0051998

(51) Int. Cl.
*F26B 13/06* (2006.01)
*F26B 19/00* (2006.01)
(Continued)

(52) U.S. Cl.
CPC ..... *F26B 25/001* (2013.01); *F26B 13/107* (2013.01); *F26B 13/14* (2013.01)

(58) Field of Classification Search
CPC ..... F26B 25/001; F26B 13/107; F26B 13/14; B65H 20/1618; B65H 2301/522; B65H 2301/52202; B65H 23/048; B65H 23/16; B65H 23/26; B65H 59/36; B65H 51/20
USPC ..... 34/236, 646–648, 657, 203, 240, 117, 34/620, 621, 625, 637, 645, 658, 660; 427/365; 226/120, 158, 162, 91, 92; 236/91, 92; 243/364.4, 153, 157.1;
(Continued)

(56) References Cited

U.S. PATENT DOCUMENTS 4,711,482 A * 12/1987 Brown et al. ..... 294/107
5,333,771 A * 8/1994 Cesario ..... 226/92
(Continued)

FOREIGN PATENT DOCUMENTS

CN 1747884 A 3/2006
CN 2924440 Y 7/2007
(Continued)

OTHER PUBLICATIONS

Chinese Office Action issued on Sep. 6, 2015 for Chinese patent application No. 2013100747886 and Request for Entry of the Accompanying Office Action attached herewith.

*Primary Examiner* — Kenneth Rinehart
*Assistant Examiner* — John McCormack
(74) *Attorney, Agent, or Firm* — Robert E. Bushnell, Esq.

(57) ABSTRACT

A drying device that includes a drying furnace having an inlet and an outlet, a drying unit installed inside the drying furnace and for drying a to-be-dried object, a number of upper and lower rolls alternately arranged at internal top and bottom portions of the drying furnace, and a roll driver connected to the plurality of upper and lower rolls and moving the upper rolls upwardly and the lower rolls downwardly, wherein after the to-be-dried object is transferred from the inlet to the outlet, the roller driver moves the upper rolls downwardly, moves the lower rolls upwardly, or moves the upper rolls downwardly and the lower rolls upwardly.

12 Claims, 11 Drawing Sheets

(51) Int. Cl.
*F26B 25/00* (2006.01)
*F26B 13/10* (2006.01)
*F26B 13/14* (2006.01)

(58) Field of Classification Search
USPC ..... 101/11; 242/417, 417.1, 417.2, 417.3, 242/153, 154
See application file for complete search history.

(56) References Cited

U.S. PATENT DOCUMENTS

| | | | | | |
|---|---|---|---|---|---|
| 5,581,908 | A * | 12/1996 | Theilacker | B65H 20/16 | 226/17 |
| 5,992,789 | A * | 11/1999 | Lamothe | B65H 20/34 | 226/112 |
| 2005/0139713 | A1* | 6/2005 | Weber | B65H 20/34 | 242/418.1 |
| 2006/0113348 | A1* | 6/2006 | Nawata | 226/44 | |
| 2006/0216405 | A1 | 9/2006 | Lee | | |
| 2011/0067260 | A1* | 3/2011 | Kim et al. | 34/201 | |
| 2012/0064233 | A1 | 3/2012 | Kim et al. | | |
| 2012/0251734 | A1 | 10/2012 | Yamazaki | | |

FOREIGN PATENT DOCUMENTS

| | | |
|---|---|---|
| JP | 2010-225467 | 10/2010 |
| KR | 1991-0011180 | 7/1991 |
| KR | 2011-0072829 | 6/2011 |
| WO | 2011073754 A1 | 6/2011 |

* cited by examiner

DRYING DEVICE

CLAIM OF PRIORITY

This application makes reference to, incorporates the same herein, and claims all benefits accruing under 35 U.S.C. §119 from an application earlier filed in the Korean Intellectual Property Office on 16 May 2012 and there duly assigned Serial No. 10-2012-0051998.

BACKGROUND OF THE INVENTION

Field of the Invention

Aspects of the present invention generally relate to a drying device.

Description of the Related Art

A general electrode plate drying device may include a drying furnace having an inlet and an outlet, a plurality of upper and lower rolls installed within the drying furnace, a blower nozzle and heater for drying the electrode plate.

The above information disclosed in this Related Art section is only for enhancement of understanding of the background of the invention and therefore it may contain information that does not form the prior art that is already known to a person of ordinary skill in the art.

SUMMARY OF THE INVENTION

One or more embodiment may provide a drying device, which can facilitate an initial process for introducing a to-be-dried object into a drying furnace, and even when the to-be-dried object is broken during a drying process, can connect the broken to-be-dried object in a more secured manner without interference between internal components of the drying furnace.

One embodiment may provide a drying device including: a drying furnace having an inlet and an outlet, a drying unit installed inside the drying furnace and for drying a to-be-dried object, a plurality of upper and lower rolls alternately arranged at internal top and bottom portions of the drying furnace, and a roll driver connected to the plurality of upper and lower rolls and moving the upper rolls upwardly and the lower rolls downwardly, wherein after the to-be-dried object is transferred from the inlet to the outlet, the roller driver moves the upper rolls downwardly, moves the lower rolls upwardly, or moves the upper rolls downwardly and the lower rolls upwardly.

The drying device may further include a to-be-dried object connection unit installed outside the drying furnace, penetrating into the drying furnace from the outside of the drying furnace through the outlet to then linearly reciprocate between the outlet and the inlet, and connecting the to-be-dried object positioned inside the drying furnace to the outlet.

The to-be-dried object connection unit may transfer the to-be-dried object positioned inside the drying furnace from the inlet to the outlet along empty spaces between the plurality of upper and lower rolls.

The drying device may further include a driving controller controlling driving of the roller driver and the to-be-dried object connection unit.

The drying device may further include a to-be-dried object connection unit installed outside the drying furnace, wherein the to-be-dried object connection unit includes a driving member penetrating from the outside to the inside of the drying furnace through the outlet, linearly reciprocating between the outlet and the inlet and connecting the to-be-dried object positioned inside the drying furnace to the outlet, and a connection member installed at a front end of the driving member and connecting and disconnecting the driving member and the to-be-dried object to/from each other.

The to-be-dried object connection unit transfers the to-be-dried object positioned inside the drying furnace from the inlet to the outlet along empty spaces between the plurality of upper and lower rolls.

The driving member may include a body, and a variable-length part which is inserted or exited from the body and whose length is varied, wherein the driving member includes one or more driving members.

The variable-length part may be formed in the shape of a bar antenna.

The connection member may be formed by tongs or clamps.

The drying device may be an electrode plate drying device for a secondary battery.

Other embodiment may provide a drying device including: a drying furnace having an inlet and an outlet, a drying unit installed inside the drying furnace and for drying a to-be-dried object, a plurality of upper and lower rolls alternately arranged at internal top and bottom portions of the drying furnace, and a roll driver connected to the plurality of upper and lower rolls and moving the upper rolls upwardly and the lower rolls downwardly, wherein when the to-be-dried object is transferred from the inlet to the outlet, the roller driver moves the upper rolls downwardly, moves the lower rolls upwardly, or moves the upper rolls downwardly and the lower rolls upwardly, and the upper and lower rollers are sequentially moved according to the transfer location of the to-be-dried object.

The drying device may further include a to-be-dried object connection unit installed outside the drying furnace, penetrating into the drying furnace from the outside of the drying furnace through the outlet to then linearly reciprocate between the outlet and the inlet, and connecting the to-be-dried object positioned inside the drying furnace to the outlet.

The to-be-dried object connection unit may transfer the to-be-dried object positioned inside the drying furnace from the inlet to the outlet along empty spaces between the plurality of upper and lower rolls.

The drying device may further include a driving controller controlling driving of the roller driver and the to-be-dried object connection unit, wherein the driving controller individually drives the plurality of upper and lower rolls sequentially from a roll adjacent to the inlet to a roll adjacent to the outlet according to the position of the transferred to-be-dried object.

The drying device may further include a to-be-dried object connection unit installed outside the drying furnace, wherein the to-be-dried object connection unit includes a driving member penetrating from the outside to the inside of the drying furnace through the outlet, linearly reciprocating between the outlet and the inlet and connecting the to-be-dried object positioned inside the drying furnace to the outlet, and a connection member installed at a front end of the driving member and connecting and disconnecting the driving member and the to-be-dried object to/from each other.

The to-be-dried object connection unit may transfer the to-be-dried object positioned inside the drying furnace from the inlet to the outlet along empty spaces between the plurality of upper and lower rolls.

The driving member may include a body, and a variable-length part which is inserted or exited from the body and whose length is varied, wherein the driving member includes one or more driving members.

The variable-length part may be formed in the shape of a bar antenna.

The connection member may be formed by tongs or clamps.

The drying device may be an electrode plate drying device for a secondary battery.

According to the present invention, an in initial process for introducing the to-be-dried object into the drying furnace can be facilitated, and even when the to-be-dried object is broken during the drying process, the broken to-be-dried object can be connected in a more secured manner without interference between internal components of the drying furnace.

Additional aspects and/or advantages of the invention will be set forth in part in the description which follows and, in part, will be obvious from the description, or may be learned by practice of the invention.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
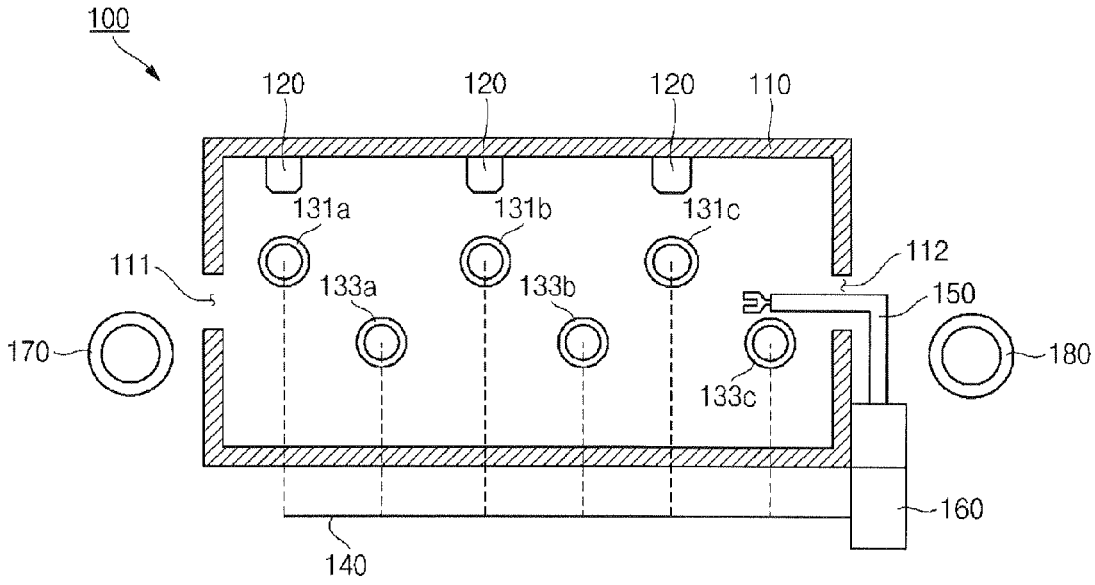
FIG. 1 illustrates a cross-sectional view schematically illustrating a drying device according to a first embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Recognizing that sizes and thicknesses of constituent members shown in the accompanying drawings are arbitrarily given for better understanding and ease of description, the present invention is not limited to the illustrated sizes and thicknesses.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. Alternatively, when an element is referred to as being "directly on" another element, there are no intervening elements present.

In order to clarify the present invention, elements extrinsic to the description are omitted from the details of this description, and like reference numerals refer to like elements throughout the specification.

In several exemplary embodiments, constituent elements having the same configuration are representatively described in a first exemplary embodiment by using the same reference numeral and only constituent elements other than the constituent elements described in the first exemplary embodiment will be described in other embodiments.

In a typical general electrode plate drying device, a guide rail or a sprocket is used to move the electrode plate within the drying furnace. This method of moving the object to be dried may employ a chain. In such a device upper and lower rolls, the guide rail or the sprocket and the chain are fixedly installed in the inner wall of the drying furnace. Therefore, since the upper and lower rolls are fixed inside the drying furnace, it is not easy to introduce the electrode plate into the drying furnace.

In addition, in a case where the electrode plate is broken while moving along the upper and lower rolls, it is necessary to draw the broken electrode plate back to the outlet using the guide rail or the sprocket and the chain. In this case, since the guide rail or the sprocket and the chain are fixed on the inner wall of the drying furnace, interference unavoidably occurs between the guide rail or the sprocket and the chain and the upper and lower rolls. Thus, it is not easy to reconnect the broken electrode plate.

Hereinafter, a drying device according to a first embodiment of the present invention will be described in detail with reference to the accompanying drawings.

Figure 2A:
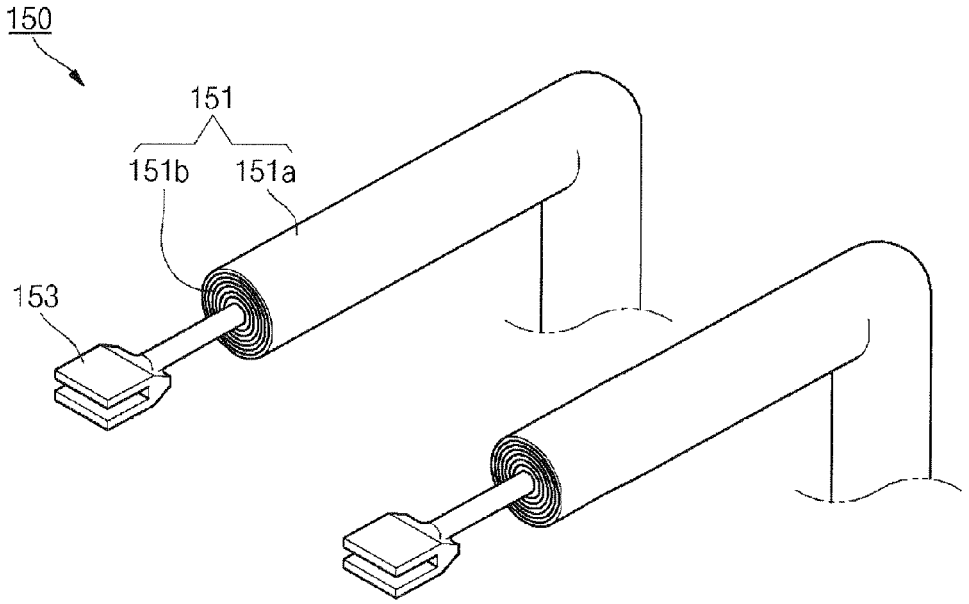
FIGS. 2A and 2B illustrate diagrams illustrating a to-be-dried object connection unit according to the first embodiment of the present invention.
Figure 2B:
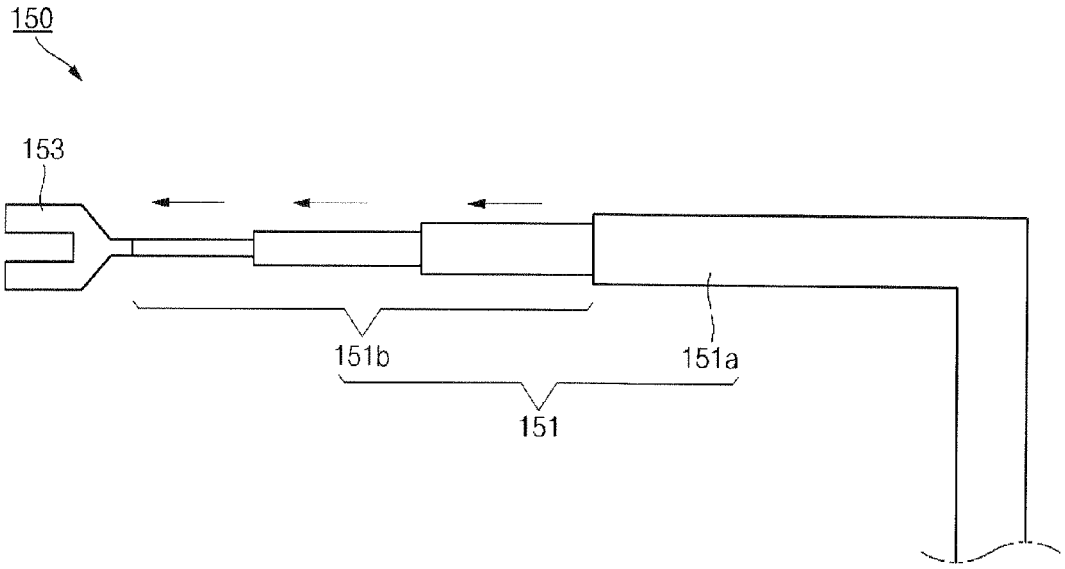

FIG. 1 is a cross-sectional view schematically illustrating a drying device 100 according to a first embodiment of the present invention and FIGS. 2A and 2B are diagrams illustrating a to-be-dried object connection unit 150 according to the first embodiment of the present invention.

Referring to FIGS. 1 to 2B, the drying device 100 according to the first embodiment of the present invention may include a drying furnace 110, a plurality of drying units 120, a plurality of upper rolls 131*a*, 131*b* and 131*c*, a plurality of lower rolls 133*a*, 133*b* and 133*c*, a roller driver 140, a to-be-dried object connection unit 150, and a driving controller 160. In addition, the drying device 100 may include an unwinding part 170 and a winding part 180.

The drying furnace 110 may be roughly box-shaped and has an inlet 111 and an outlet 112 opened at regions of its opposite ends substantially in slit shapes. The unwinding part 170 may be disposed in front end of the inlet 111. The unwinding part 170 allows the wound to-be-dried object 10 to be supplied to the inlet 111 of the drying furnace 110, and the winding part 180 winds the to-be-dried object 10 discharged through the outlet 112 after it is dried. The to-be-dried object 10 may be an electrode plate that is coated with an electrode active material and then rolled. In the following description, for the sake of convenient explanation, the to-be-dried object 10 will be described by way of example with regard to the electrode plate that is coated with an electrode active material and then rolled.

The plurality of drying units 120 are installed at top portions of the drying furnace 110 and may include a blower nozzle and a heater. The blower nozzle may be configured to ventilate the electrode plate 10 guided by the plurality of upper rolls 131*a*, 131*b* and 131*c* and the lower rolls 133*a*, 133*b* and 133*c* through a ventilation hole. In addition, the plurality of drying units 120 may send hot wind maintained at predetermined temperature and humidity using the heater.

The plurality of upper rolls 131*a*, 131*b* and 131*c* and the plurality of lower rolls 133*a*, 133*b* and 133*c* are installed inside the drying furnace 110 and are alternately arranged at internal top and bottom portions of the drying furnace 110. For example, the plurality of upper rolls 131*a*, 131*b* and 131*c* may include a first upper roll 131*a*, a second upper roll 131*b* and a third upper roll 131*c*, and the plurality of lower rolls 133*a*, 133*b* and 133*c* may include a first lower roll 133*a*, a second lower roll 133*b* and a third lower roll 133*c*. The plurality of upper rolls 131*a*, 131*b* and 131*c* may be arranged from the inlet 111 to the outlet 112 of the drying furnace 110 sequentially from the first upper roll 131*a*, the first lower roll 133*a*, the second upper roll 131*b*, the second lower roll 133*b*, the third upper roll 131*c*, and the third lower roll 133*c*. In the embodiment of the present invention, the first to third upper rolls 131*a*, 131*b* and 131*c* and the first to third lower rolls 133*a*, 133*b* and 133*c* are provided only for illustration, but not limited thereto.

The first to third upper rolls 131*a*, 131*b* and 131*c* and the first to third lower rolls 133*a*, 133*b* and 133*c* function to guide the electrode plate 10 from the inlet 111 to the outlet 112 of the drying furnace 110. In addition, the first to third upper rolls 131*a*, 131*b* and 131*c* and the first to third lower rolls 133*a*, 133*b* and 133*c* may be upwardly and downwardly moved by the roller driver 140 such that the electrode plate 10 positioned inside the drying furnace 110 has the maximum area. Driving methods of the first to third upper rolls 131*a*, 131*b* and 131*c* and the first to third lower rolls 133*a*, 133*b* and 133*c* will be described below in more detail.

The roller driver 140 may be installed within the drying furnace 110 and may be connected to the plurality of upper rolls 131*a*, 131*b* and 131*c* and the plurality of lower rolls 133*a*, 133*b* and 133*c*, respectively. In addition, the roller driver 140 may upwardly and downwardly move the first to third upper rolls 131*a*, 131*b* and 131*c* and the first to third lower rolls 133*a*, 133*b* and 133*c* using a plurality of rails (not shown) installed inside the drying furnace 110, respectively. A driving method of the roller driver 140 will be described below in more detail.

The to-be-dried object connection unit 150 may be installed outside the drying furnace 110 and may be configured to penetrate into the drying furnace 110 from the outside of the drying furnace 110 through the outlet 112 and to linearly reciprocate between the outlet 112 and the inlet 111. The to-be-dried object connection unit 150 may transfer the electrode plate 10 to the outlet 112 positioned within the drying furnace 110. For example, in an initial process for introducing the electrode plate 10 positioned outside the drying furnace 110 into the drying furnace 110, the to-be-dried object connection unit 150 may transfer the electrode plate 10 injected into the drying furnace 110 through the inlet 111 to the outlet 112. In addition, in a case where the electrode plate 10 is broken at an arbitrary position inside the drying furnace 110 during a drying process, the to-be-dried object connection unit 150 is connected to the broken electrode plate 10 to then be transferred to the outlet 112. Here, the to-be-dried object connection unit 150 may linearly reciprocate in a direction ranging from the inlet 111 to the outlet 112 along empty spaces provided between the first to third upper rolls 131*a*, 131*b* and 131*c* and the first to third lower rolls 133*a*, 133*b* and 133*c* and may transfer the electrode plate 10 to the outlet 112 while moving along the empty spaces.

As shown in FIGS. 2A and 2B, the to-be-dried object connection unit 150 may include a driving member 151 and a connection member 153 and may consist of one or more to-be-dried object connection units.

The driving member 151 includes a body 151*a* and a variable-length part 151*b*. The body 151*a* allows the to-be-dried object connection unit 150 to be supported from the outside of the drying furnace 110 and may accommodate the variable-length part 151*b*. The variable-length part 151*b* may be initially accommodated within the body 151*a* and its length may be variably adjusted during driving while it is sequentially injected and exited from the body 151*a*. The variable-length part 151*b* may be formed in the shape of a bar antenna. For example, the variable-length part 151*b* may be driven such that a plurality of driving bodies are initially surrounded in many folds within the body 151*a* and then sequentially exited from the body 151*a* during driving. Then, in a case of returning to the initial state, the exited driving bodies may be inserted in the opposite order to the order in which they are exited during driving.

The connection member 153 may be installed at the front end of the driving member 151. Here, the front end of the driving member 151 means a front end of the driving body positioned farthest from the body 151*a* when the variable-length part 151*b* is drawn out so as to have the maximum length, or a front end of the innermost driving body among the plurality of driving bodies. The connection member 153 may be formed by tongs or clamps, thereby connecting or disconnecting the driving member 151 and the electrode plate 10 to/from each other, but aspects of the present invention are not limited thereto. Rather, the connection member 153 may be formed by any other component as long as it can connect or disconnect the electrode plate 10 and the driving member 151 to/from each other and can minimize damages of the electrode plate 10 when the electrode plate 10 and the driving member 151 are connected to each other.

The driving methods of the to-be-dried object connection unit 150 may include, for example, linear reciprocation enabling methods using a gear as a motor driving source, or using compressed air or vacuum.

The driving controller 160 may be connected to the roller driver 140 and the to-be-dried object connection unit 150 to control driving of the same, respectively. For example, the driving controller 160 may be connected to the first to third upper rolls 131*a*, 131*b* and 131*c* and the first to third lower rolls 133*a*, 133*b* and 133*c*, respectively, and moves the first to third upper rolls 131*a*, 131*b* and 131*c* upwardly and downwardly, moves the first to third lower rolls 133*a*, 133*b* and 133*c* upwardly and downwardly, or move the first to third upper rolls 131*a*, 131*b* and 131*c* and the first to third lower rolls 133*a*, 133*b* and 133*c* upwardly and downwardly. In addition, the driving controller 160 may drive the to-be-dried object connection unit 150 to extend from the outlet 112 to the inlet 111 during an initial process of the drying device 110, and may drive the to-be-dried object connection unit 150 to shrink back to the outlet 112 after the to-be-dried object connection unit 150 may be connected to the electrode plate 10. In addition, in a case where the electrode plate 10 is broken during the drying process, the driving controller 160 may drive the to-be-dried object connection unit 150 to extend from the outlet 112 to a position where the electrode plate 10 is broken and may drive the to-be-dried object connection unit 150 to shrink back to the outlet 112 after the to-be-dried object connection unit 150 is connected to the electrode plate 10.

Hereinafter, driving methods of the first to third upper rolls 131*a*, 131*b* and 131*c*, the first to third lower rolls 133*a*, 133*b* and 133*c* and the to-be-dried object connection unit 150 will now be described.

First, a first driving method of the drying device 100 according to the first embodiment of the present invention will be described.

Figure 3A:
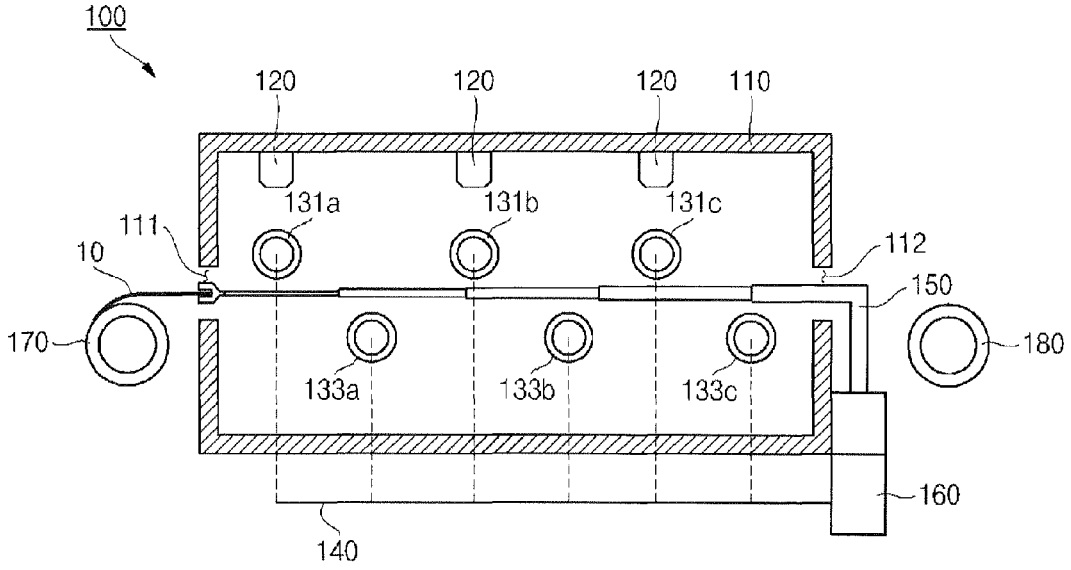
FIGS. 3A through 3C illustrate diagrams illustrating a first driving method of the drying device shown in FIG. 1.
Figure 3B:
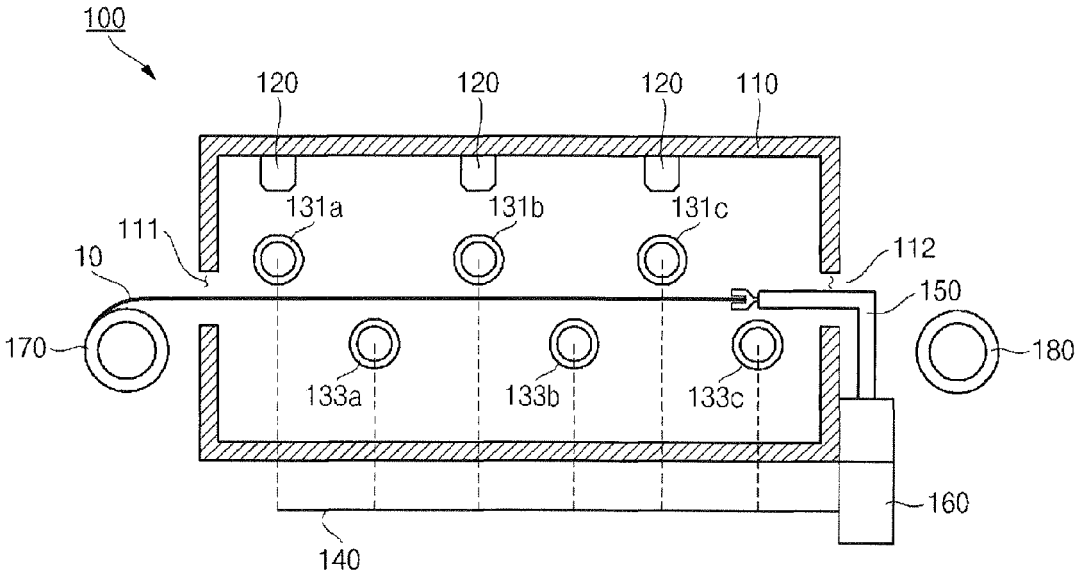
Figure 3C:
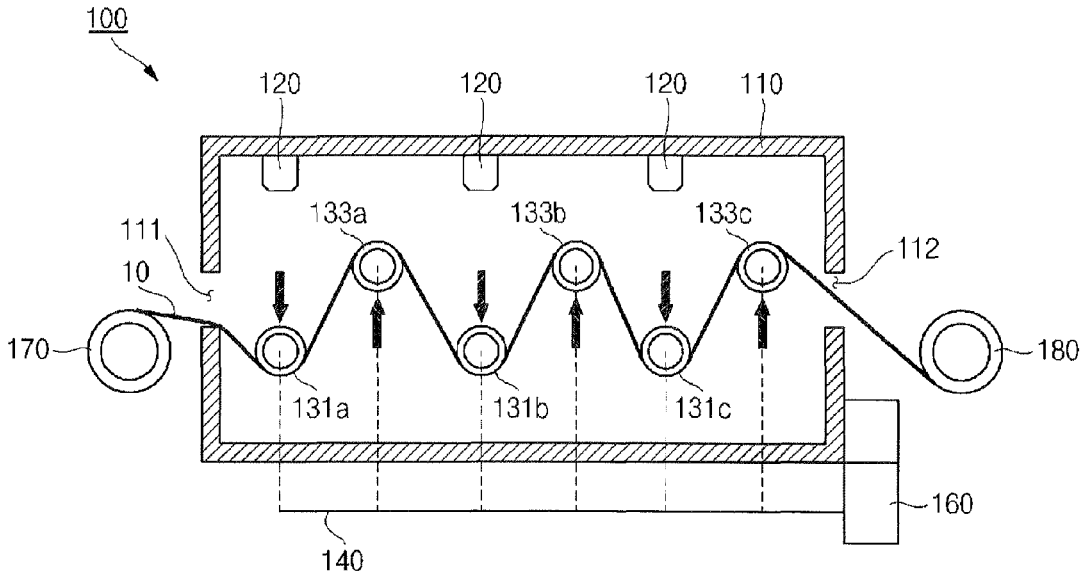

FIGS. 3A through 3C are diagrams illustrating a first driving method of the drying device shown in FIG. 1.

In preparation of drying of the drying device 100, the plurality of upper rolls 131*a*, 131*b* and 131*c* and lower rolls 133*a*, 133*b* and 133*c* are aligned at their initial positions. Then, a front end of the electrode plate 10 wound around the unwinding part 170 may be positioned at the inlet 111 of the drying furnace 110.

Next, as shown in FIG. 3A, the to-be-dried object connection unit 150 positioned at the outlet 112 may be driven to extend to the inlet 111. Here, the to-be-dried object connection unit 150 extends along empty spaces between the first to third upper rolls 131*a*, 131*b* and 131*c* and the first to third lower rolls 133*a*, 133*b* and 133*c*, while not making a contact with any component in the drying furnace 110. Thereafter, the to-be-dried object connection unit 150 and the electrode plate 10 are connected to each other.

Next, as shown in FIG. 3B, the to-be-dried object connection unit 150 returns to its initial state, thereby transferring the electrode plate 10 to the outlet 112. Here, as described above, the to-be-dried object connection unit 150 extends along empty spaces between the first to third upper rolls 131*a*, 131*b* and 131*c* and the first to third lower rolls 133*a*, 133*b* and 133*c* and makes no contact with any component in the drying furnace 110. Thereafter, the to-be-dried object connection unit 150 may be separated from the electrode plate 10, and the electrode plate 10 transferred to the outlet 112 may be connected to the winding part 180.

Next, as shown in FIG. 3C, the first to third upper rolls 131*a*, 131*b* and 131*c* move downwardly, and the first to third lower rolls 133*a*, 133*b* and 133*c* move upwardly, thereby completing the drying preparation process.

Thereafter, while the unwinding part 170 and the winding part 180 rotate, the electrode plate 10 moves within the drying furnace 110 along the first to third upper rolls 131*a*, 131*b* and 131*c* and the first to third lower rolls 133*a*, 133*b* and 133*c*. In addition, the electrode plate 10 is dried by the drying units 120 while moving within the drying furnace 10.

Next, a second driving method of the drying device 100 according to the first embodiment of the present invention will be described.

Figure 4A:
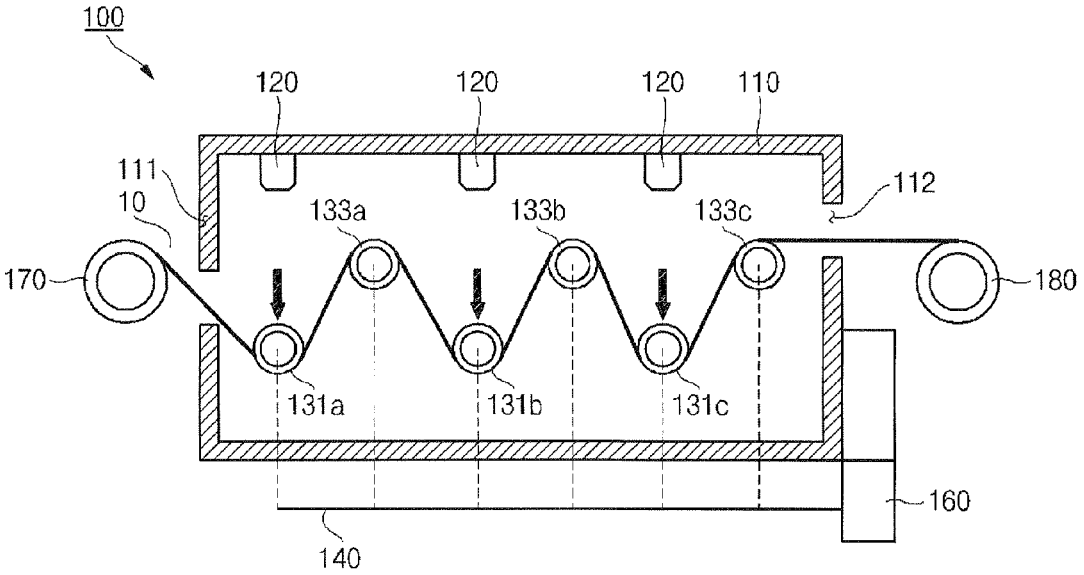
FIGS. 4A and 4B illustrate diagrams illustrating second and third driving methods of the drying device shown in FIG. 1.

FIG. 4A is a diagram illustrating a second driving method of the drying device 100 according to the first embodiment of the present invention.

Unlike in the first driving method, in the second driving method of the drying device 100, after the electrode plate 10 is connected between the unwinding part 170 and the winding part 180, all of the first to third upper rolls 131*a*, 131*b* and 131*c* and the first to third lower rolls 133*a*, 133*b* and 133*c* are not moved and only some of the first to third upper rolls 131*a*, 131*b* and 131*c* and the first to third lower rolls 133*a*, 133*b* and 133*c* are moved. For example, the first to third upper rolls 131*a*, 131*b* and 131*c* may move downwardly. Here, the first to third upper rolls 131*a*, 131*b* and 131*c* are positioned lower than the first to third lower rolls 133*a*, 133*b* and 133*c*.

Next, a third driving method of the drying device 100 according to the first embodiment of the present invention will be described.

Figure 4B:
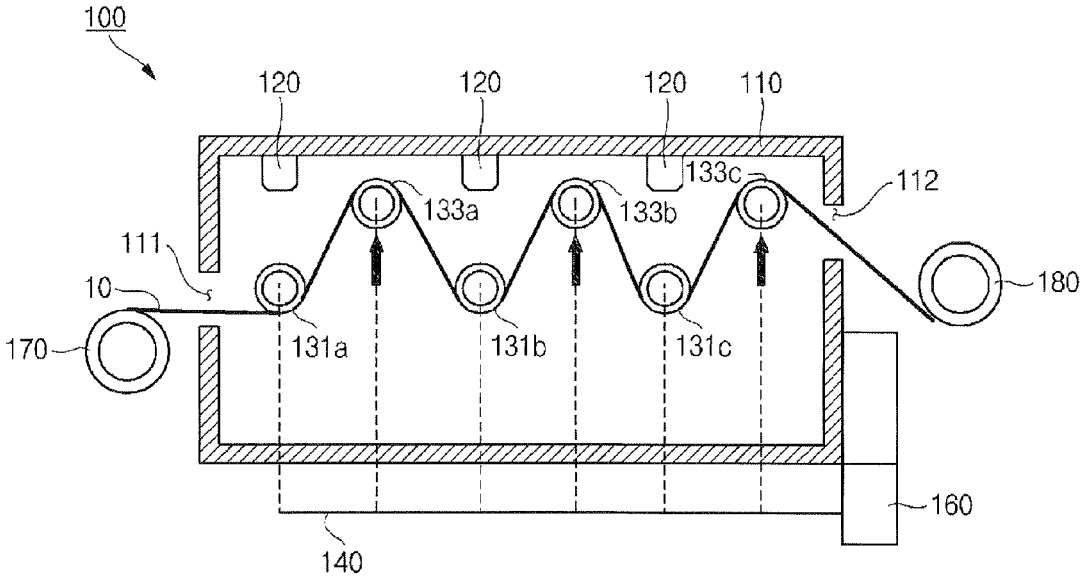

FIG. 4B is a diagram illustrating a third driving method of the drying device 100 according to the first embodiment of the present invention.

Unlike in the second driving method, in the third driving method of the drying device 100, after the electrode plate 10 may be connected between the unwinding part 170 and the winding part 180, the first to third upper rolls 131*a*, 131*b* and 131*c* are not moved but the first to third lower rolls 133*a*, 133*b* and 133*c* are moved upwardly. Here, the first to third lower rolls 133*a*, 133*b* and 133*c* are positioned higher than the first to third upper rolls 131*a*, 131*b* and 131*c*.

The first driving method of the drying device 100 according to the first embodiment of the present invention will now be compared with the second and third driving methods. In the first driving method of the drying device 100 according to the first embodiment of the present invention, all of the first to third upper rolls 131*a*, 131*b* and 131*c* and the first to third lower rolls 133*a*, 133*b* and 133*c* are moved, thereby maximizing a movement path of the electrode plate 10 within the drying furnace 110. In the second and third driving methods, since only some of the rolls are moved while the rest rolls are fixed, the costs for installing and maintaining the roller driver can be reduced.

Hereinafter, a drying device 200 according to a second embodiment of the present invention will be described.

FIGS. 5A through 5D illustrate a configuration and a first driving method of a drying device 200 according to a second embodiment of the present invention.

Referring to FIGS. 5A to 5D, the drying device 200 according to the second embodiment of the present invention may include a drying furnace 210, a plurality of drying unit 220, a plurality of upper rolls 231*a*, 231*b* and 231*c*, a plurality of lower rolls 233*a*, 233*b* and 233*c*, a roller driver 240, a to-be-dried object connection unit 250, and a driving controller 260. In addition, the drying device 200 may include an unwinding part 270 and a winding part 280.

The drying furnace 210, the drying unit 220, the upper rolls 231*a*, 231*b* and 231*c*, the lower rolls 233*a*, 233*b* and 233*c*, the roller driver 240, the to-be-dried object connection unit 250, and the driving controller 260 of the drying device 200 according to the second embodiment of the present invention are substantially the same as the drying furnace 110, the drying units 120, the upper rolls 131*a*, 131*b* and 131*c*, the lower rolls 133*a*, 133*b* and 133*c*, the roller driver 140, the to-be-dried object connection unit 150, and the driving controller 160 of the drying device 100 according to the first embodiment of the present invention. However, the drying device 200 according to the second embodiment of the present invention may be different from the drying device 100 according to the first embodiment of the present invention in view of methods in which the driving controller 260 drives and controls the roller driver 240 and the to-be-dried object connection unit 250.

In preparation of an initial process, the driving controller 260 according to the second embodiment of the present invention individually drives the plurality of upper rolls 231*a*, 231*b* and 231*c* and the plurality of lower rolls 233*a*, 233*b* and 233*c* sequentially according to the transferred position of the electrode plate 10.

Hereinafter, a driving method of the drying device 200 according to the second embodiment of the present invention will be described in detail. Since the configuration of the drying device 200 according to the second embodiment of the present invention is substantially the same as that of the drying device 100 according to the first embodiment of the present invention, a detailed description thereof will not be repeated.

The first driving method of the drying device 200 according to the second embodiment of the present invention will now be described.

In preparation of drying of the drying device 200, the first to third upper rolls 231*a*, 231*b* and 231*c* and the first to third lower rolls 233*a*, 233*b* and 233*c* are aligned at their initial positions. Then, a front end of the electrode plate 10 wound around the unwinding part 270 may be positioned at the inlet 211 of the drying furnace 210.

Figure 5A:
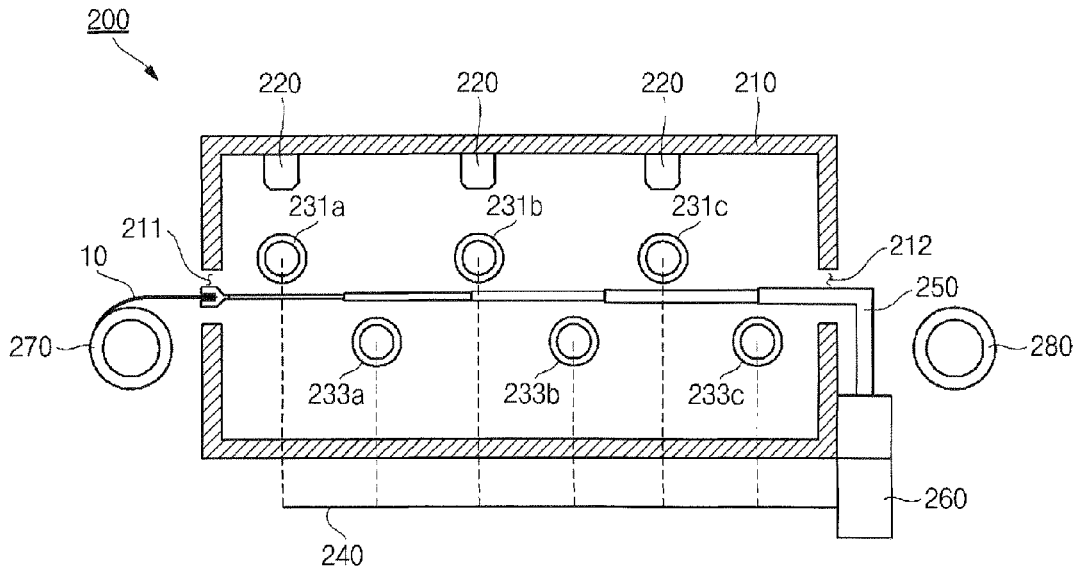
FIGS. 5A through 5D illustrate a configuration and a first driving method of a drying device according to a second embodiment of the present invention.

Next, as shown in FIG. 5A, the to-be-dried object connection unit 250 positioned at the outlet 212 may be driven to extend to the inlet 211. Here, the to-be-dried object connection unit 250 extends along empty spaces between the first to third upper rolls 231*a*, 231*b* and 231*c* and the first to third lower rolls 233*a*, 233*b* and 233*c*, while not making a contact with any component in the drying furnace 210. Thereafter, the to-be-dried object connection unit 250 and the electrode plate 10 are connected to each other.

Figure 5B:
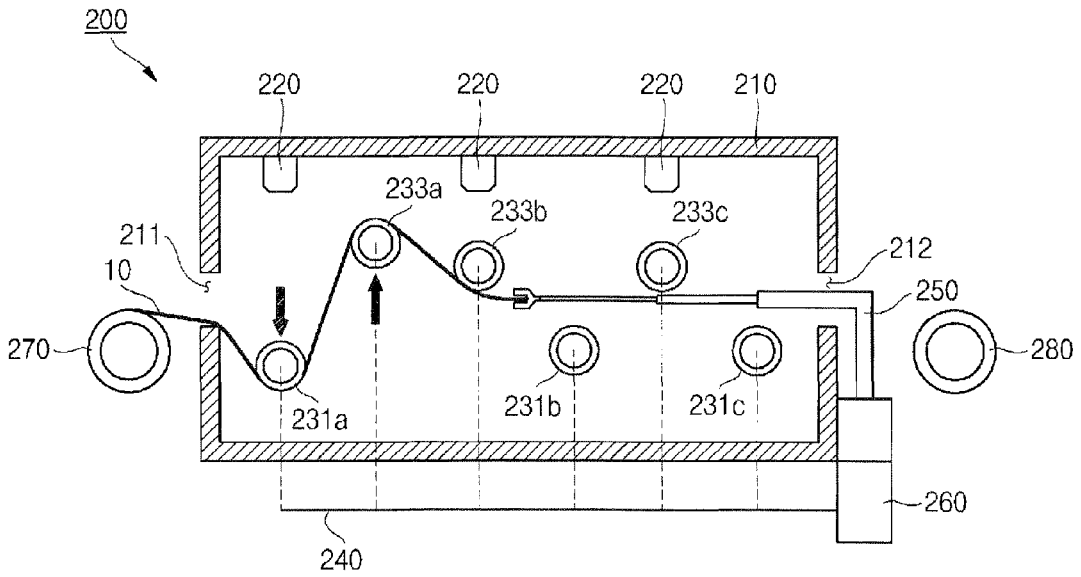

Next, as shown in FIG. 5B, the to-be-dried object connection unit 250 begins to return to its initial state, and the electrode plate 10 begins to be transferred to the outlet 212. Here, the to-be-dried object connection unit 250 moves along empty spaces between the first to third upper rolls 231*a*, 231*b* and 231*c* and the first to third lower rolls 233*a*, 233*b* and 233*c* while shrinking. Thereafter, the first upper roll 231*a* moves downwardly and the first lower roll 233*a* moves upwardly.

Figure 5C:
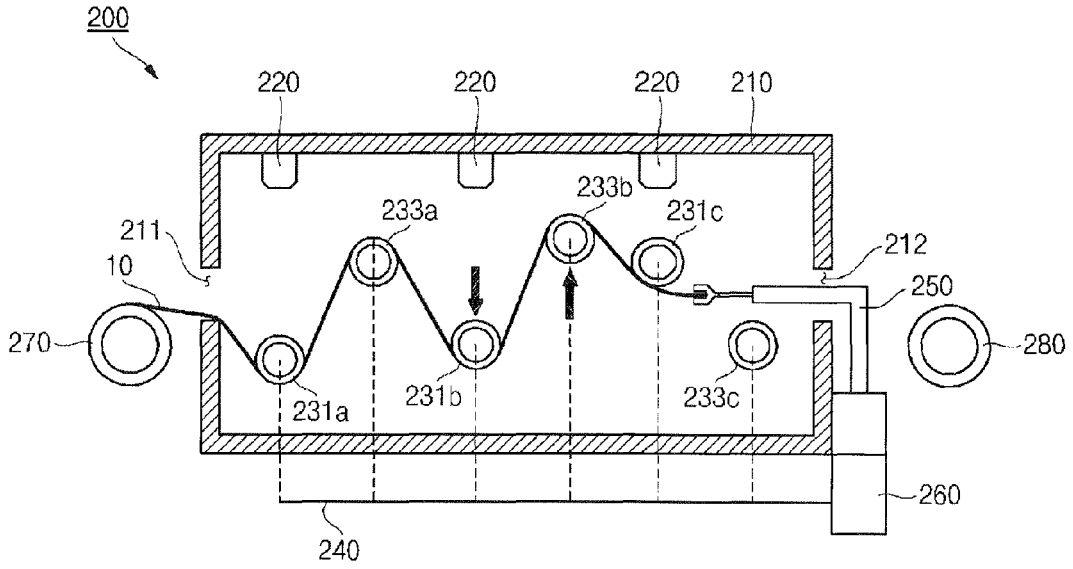

Next, as shown in FIG. 5C, the to-be-dried object connection unit 250 moves along an empty space between the second upper roll 231*b* and the second lower roll 233*b* while shrinking. Thereafter, the second upper roll 231*b* moves downwardly and the second lower roll 233*b* moves upwardly.

Figure 5D:
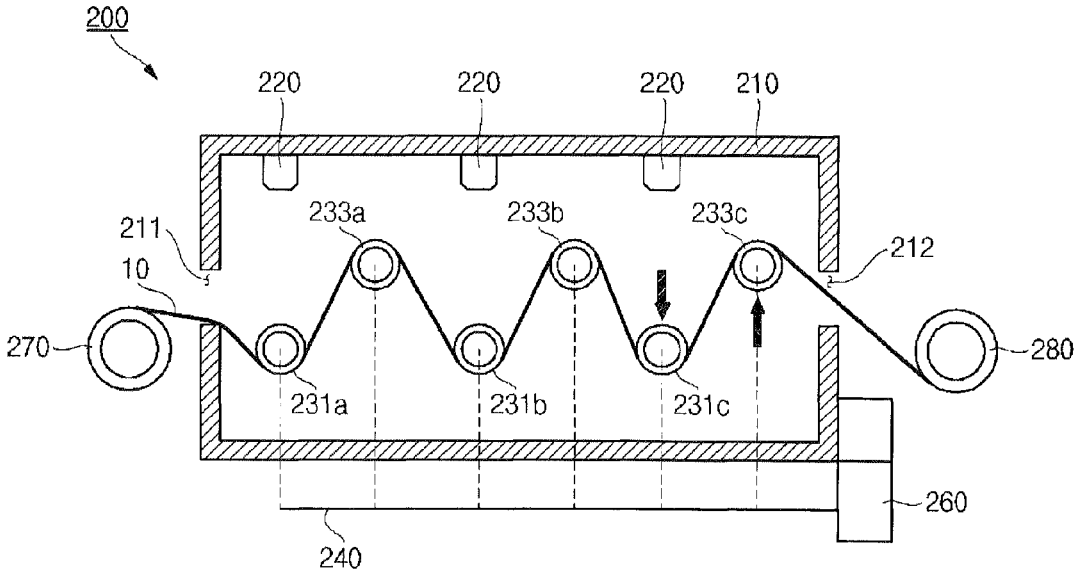

Next, as shown in FIG. 5D, if the to-be-dried object connection unit 250 moves along the empty space between the third upper roll 231*c* and the third lower roll 233*c*, the electrode plate 10 may be transferred to the outlet 212. Thereafter, the third upper rolls 231*c* moves downwardly, and the third lower rolls 233*c* moves upwardly. Thereafter, the to-be-dried object connection unit 250 may be separated from the electrode plate 10, and the electrode plate 10 transferred to the outlet 212 of the drying furnace 210 may be connected to the winding part 280.

Figure 6A:
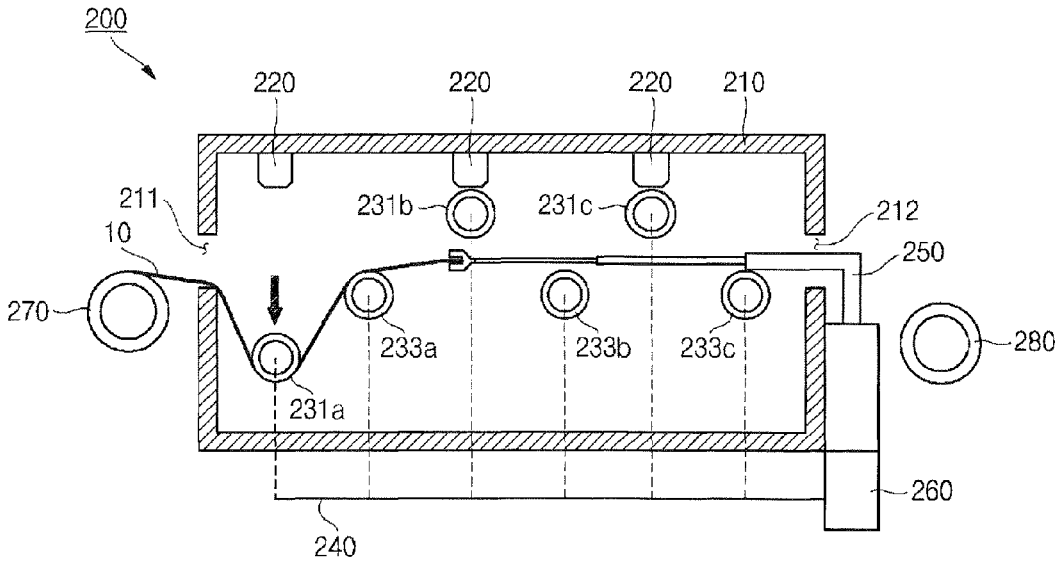
FIGS. 6A through 6C illustrate a configuration and a second driving method of a drying device according to the second embodiment of the present invention.
Figure 6B:
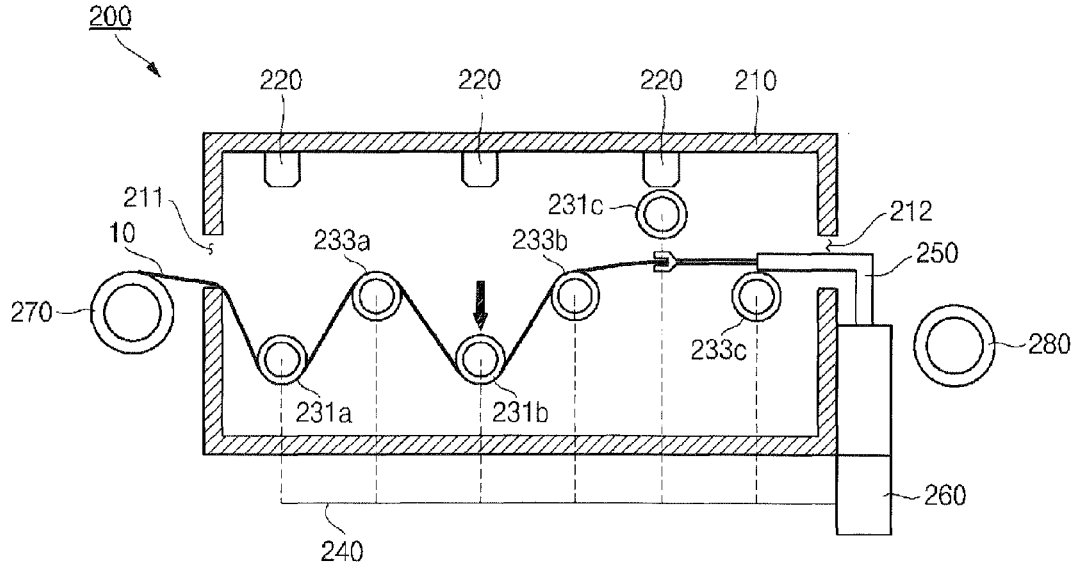
Figure 6C:
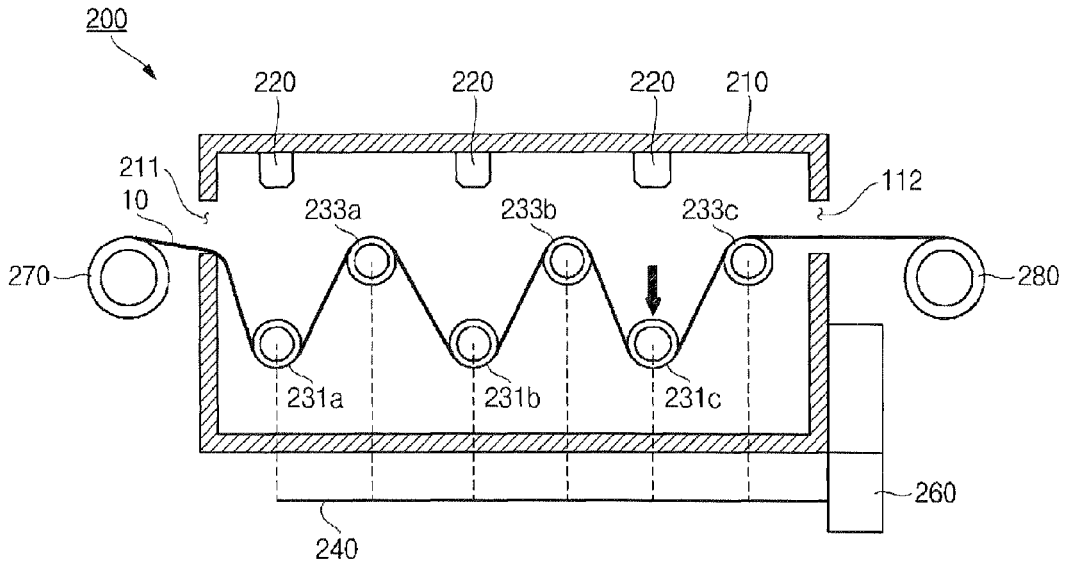

FIGS. 6A through 6C illustrate a configuration and a second driving method of a drying device 200 according to the second embodiment of the present invention.

The second driving method of the drying device 200 according to the second embodiment of the present invention will now be described.

Unlike in the first driving method, in the second driving method of the drying device 200, while the electrode plate 10 is moved to the outlet 212 by the to-be-dried object connection unit 250, all of the first to third upper rolls 231*a*, 231*b* and 231*c* and the first to third lower rolls 233*a*, 233*b* and 233*c* are not moved but only some of the first to third upper rolls 231*a*, 231*b* and 231*c* and the first to third lower rolls 233*a*, 233*b* and 233*c* are moved. For example, only the first to third upper rolls 231*a*, 231*b* and 231*c* may be sequentially moved downwardly. Here, the first to third upper rolls 231*a*, 231*b* and 231*c* are positioned lower than the first to third lower rolls 233*a*, 233*b* and 233*c*.

Figure 7A:
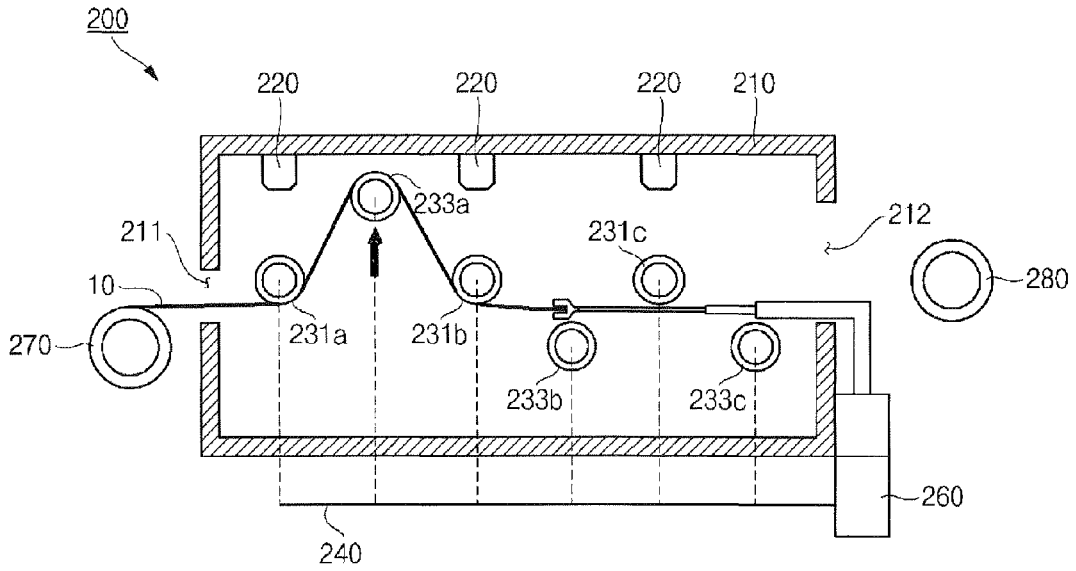
FIGS. 7A through 7C illustrate a configuration and a third driving method of a drying device according to the second embodiment of the present invention.
Figure 7B:
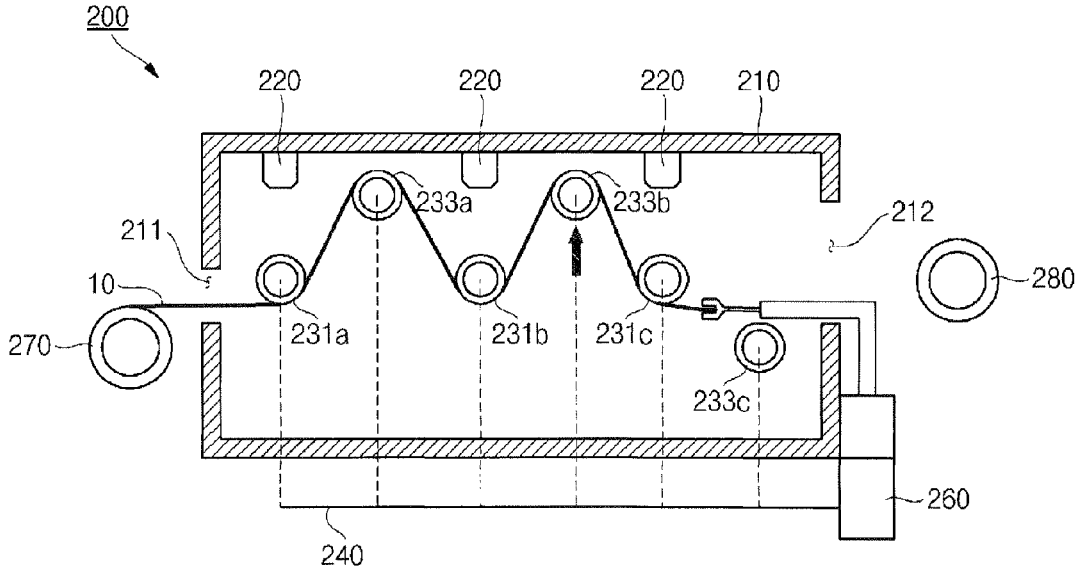
Figure 7C:
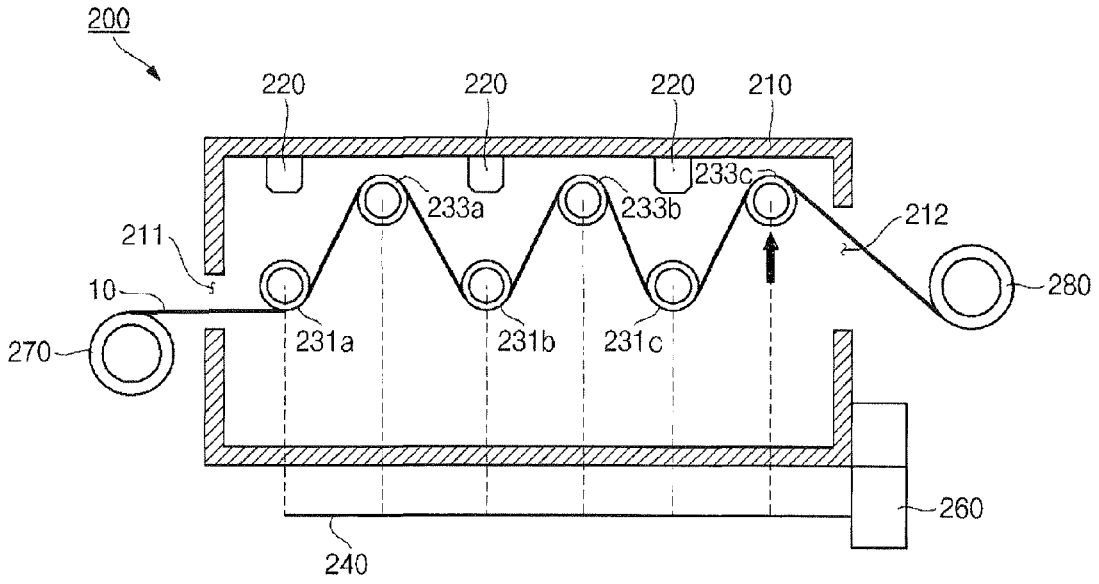

FIGS. 7A through 7C illustrate a configuration and a third driving method of a drying device 200 according to the second embodiment of the present invention.

The third driving method of the drying device 200 according to the second embodiment of the present invention will now be described.

Unlike in the second driving method, in the third driving method of the drying device 200, only the first to third lower rolls 233*a*, 233*b* and 233*c* are sequentially moved upwardly. Here, the first to third lower rolls 233*a*, 233*b* and 233*c* are positioned higher than the first to third upper rolls 231*a*, 231*b* and 231*c*.

According to the embodiments of the present invention, in preparation of the initial process in which the to-be-dried object is connected from the inlet to the outlet, or in the drying process, there is no interference between internal components of the drying furnace, thereby facilitating the initial process and enabling the drying process in a more secured and continuous manner.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

What is claimed is:

1. A drying device comprising:

a drying furnace having an inlet and an outlet;

a drying unit installed inside the drying furnace and for drying a to-be-dried object;

a plurality of upper and lower rolls alternately arranged at internal top and bottom portions of the drying furnace, said top and bottom portions being on opposite sides of the drying furnace;

a roller driver connected to the plurality of upper and lower rolls and moving the upper rolls upwardly toward the top portion and the lower rolls downwardly toward the bottom portion;

a to-be-dried object connection unit attached to an exterior of the drying furnace adjacent to the outlet having a driving member and a connection member, said driving member includes a body containing a variable length part, said connection member is installed at a front end of the variable length part; and a driving controller controlling the roller driver and the to-be-dried object connection unit, said driving controller extends the variable length part from the outlet in a telescoping manner linearly along the midline of the drying furnace between the plurality of upper rolls and the plurality of lower rolls out through the inlet with the connection member grasping the to-be-dried object outside of the drying furnace, upon grasping the to-be-dried object the driving controller retracts the variable length part pulling the to-be-dried object through the drying furnace linearly along the midline of the drying furnace and out through the outlet, wherein when the to-be-dried object is transferred from the inlet to the outlet, the roller driver controlled by the driving controller moves the upper rolls downwardly toward the bottom portion and the lower rolls upwardly toward the upper portion with each of the upper and lower rollers moved individually, independently and sequentially in an up and down direction toward the upper rollers and/or the lower rollers according to a transfer location of the to-be-dried object as the to-be-dried object is pulled through the drying furnace.

2. The drying device of claim 1, wherein the to-be-dried object connection unit transfers the to-be-dried object positioned inside the drying furnace from the inlet to the outlet along empty spaces between the plurality of upper and lower rolls.

3. The drying device of claim 1, wherein the driving member includes one or more driving members.

4. The drying device of claim 1, wherein the variable-length part is a bar antenna shape.

5. The drying device of claim 1, wherein the connection member are tongs or clamps.

6. The drying device of claim 1, wherein the drying device is an electrode plate drying device for a secondary battery.

7. A drying device comprising:

a drying furnace having an inlet and an outlet;

a drying unit installed inside the drying furnace and for drying a to-be-dried object;

a plurality of upper and lower rolls, said plurality of upper rolls arranged at an internal top portion of the drying furnace and said plurality lower rolls arranged at a bottom portion of the drying furnace in which the top portion of the drying furnace is on an opposite side of a midline of the drying furnace to the bottom portion of the drying furnace;

a roller driver connected to the plurality of upper rolls to move the plurality of upper rollers toward the bottom portion or the upper portion of the drying furnace and connected to the plurality of lower rolls to move the plurality of lower rolls toward the upper portion or the bottom portion of the drying furnace;

a to-be-dried object connection unit attached to an exterior of the drying furnace adjacent to the outlet having a driving member and a connection member, said driving member includes a body containing a variable length part, said connection member is installed at a front end of the variable length part; and a driving controller controlling the roller driver and the to-be-dried object connection unit, said driving controller extends the variable length part from the outlet in a telescoping manner linearly along the midline of the drying furnace between the plurality of upper rolls and the plurality of lower rolls out through the inlet with the connection member grasping the to-be-dried object outside of the drying furnace, upon grasping the to-be-dried object the driving controller retracts the variable length part pulling the to-be-dried object through the drying furnace linearly along the midline of the drying furnace and out through the outlet, wherein after the to-be-dried object is transferred from the inlet to the outlet, the roller driver controlled by the driving controller moves the upper rolls toward the bottom portion of the drying furnace and moves the lower rolls toward the upper portion of the drying furnace with each of the upper and lower rollers are moved individually, independently and sequentially in an up and down direction toward the upper rollers and/or the lower rollers according to a transfer location of the to-be-dried object as the to-be-dried object is pulled through the drying furnace.

8. The drying device of claim 7, wherein the to-be-dried object connection unit transfers the to-be-dried object positioned inside the drying furnace from the inlet to the outlet along empty spaces between the plurality of upper and lower rolls.

9. The drying device of claim 7, wherein the driving member includes one or more driving members.

10. The drying device of claim 7, wherein the variable-length part has a bar antenna shape.

11. The drying device of claim 7, wherein the connection member are tongs or clamps.

12. The drying device of claim 7, wherein the drying device is an electrode plate drying device for a secondary battery.

* * * * *